United States Patent [19]

Voorhees

[11] Patent Number: 4,482,005

[45] Date of Patent: Nov. 13, 1984

[54] PROCESS FOR TREATING MATERIALS TO IMPROVE THEIR STRUCTURAL CHARACTERISTICS

[75] Inventor: Joseph E. Voorhees, Lake Winola, Pa.

[73] Assignee: Endure, Inc., Dallas, Pa.

[21] Appl. No.: 567,758

[22] Filed: Jan. 3, 1984

[51] Int. Cl.[3] ..... F25B 13/00

[52] U.S. Cl. ..... 165/2; 62/64; 62/65; 148/125

[58] Field of Search ..... 62/62, 64, 65, 78; 165/2, 14; 148/125

[56] References Cited

U.S. PATENT DOCUMENTS

| | | | |
|---|---|---|---|
| 2,197,365 | 4/1940 | Kjerrman | 148/125 |
| 2,624,688 | 1/1953 | Svenson | 148/125 |
| 2,949,392 | 8/1960 | Willey | 148/125 |
| 2,958,617 | 11/1960 | Perry | 148/125 |
| 2,990,275 | 6/1961 | Binder et al. | 148/125 |
| 3,185,600 | 5/1965 | Dullberg | 148/125 |
| 3,819,428 | 6/1974 | Moore | 148/125 |
| 3,829,334 | 8/1974 | Vitosky et al. | 148/125 |
| 3,891,477 | 6/1975 | Lance | 62/65 |
| 3,997,376 | 12/1976 | Hembath | 62/64 |
| 4,011,112 | 3/1977 | Sakasegawa et al. | 62/64 |

*Primary Examiner*—Ronald C. Capossela

*Attorney, Agent, or Firm*—Fitzpatrick, Cella, Harper & Scinto

[57] ABSTRACT

A process for treating a material to improve its structural characteristics comprises the steps of suspending the material closely above a cryogenic liquid for between about two hours and about four hours and, thereafter, completely immersing the material from its suspended position into the cryogenic liquid within about two seconds to about ten seconds. The rate of evaporation of the cryogenic liquid is then controlled so that the material is completely exposed to only gases within about five hours to about ten hours and, subsequently, the temperature of the material is controlled to rise from the cryogenic level to about −50° F. within about eleven hours to about sixteen hours. After the material temperature reaches about −50° F. within the specified time, the material is then allowed to return to ambient temperature of between about 65° F. and about 70° F. Thereafter, the material is heated to a temperature within the range of about 330° F. to about 370° F. for between about one hour and about five hours. When the heating step is finished, the material is allowed to return to its ambient temperature and the process is complete.

34 Claims, 1 Drawing Figure

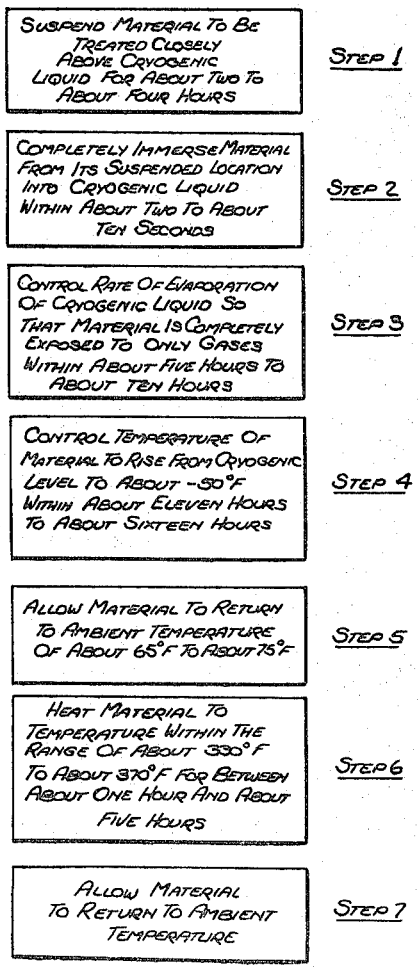

| | |
|---|---|
| SUSPEND MATERIAL TO BE TREATED CLOSELY ABOVE CRYOGENIC LIQUID FOR ABOUT TWO TO ABOUT FOUR HOURS | STEP 1 |
| COMPLETELY IMMERSE MATERIAL FROM ITS SUSPENDED LOCATION INTO CRYOGENIC LIQUID WITHIN ABOUT TWO TO ABOUT TEN SECONDS | STEP 2 |
| CONTROL RATE OF EVAPORATION OF CRYOGENIC LIQUID SO THAT MATERIAL IS COMPLETELY EXPOSED TO ONLY GASES WITHIN ABOUT FIVE HOURS TO ABOUT TEN HOURS | STEP 3 |
| CONTROL TEMPERATURE OF MATERIAL TO RISE FROM CRYOGENIC LEVEL TO ABOUT -50°F WITHIN ABOUT ELEVEN HOURS TO ABOUT SIXTEEN HOURS | STEP 4 |
| ALLOW MATERIAL TO RETURN TO AMBIENT TEMPERATURE OF ABOUT 65°F TO ABOUT 75°F | STEP 5 |
| HEAT MATERIAL TO TEMPERATURE WITHIN THE RANGE OF ABOUT 330°F TO ABOUT 370°F FOR BETWEEN ABOUT ONE HOUR AND ABOUT FIVE HOURS | STEP 6 |
| ALLOW MATERIAL TO RETURN TO AMBIENT TEMPERATURE | STEP 7 |

PROCESS FOR TREATING MATERIALS TO IMPROVE THEIR STRUCTURAL CHARACTERISTICS

BACKGROUND OF THE INVENTION

1. Field of the Invention

The present invention relates to a process for treating materials to improve their structural characteristics. This process may be used with particular advantage to treat metals used to make tools, such as drill bits and cutting knives, that are subject to wear. This process may be used with equal advantage to treat metals such as welding tips that are consumed when used. In both cases, metals treated with this process wear or are consumed at substantially lower rates than do the same metals when not treated.

The process of the subject invention may also be used to treat materials other than metals to improve their structural characteristics so as to provide longer useful life.

2. Description of the Prior Art

Many processes for treating metals and other materials are now known. For example, U.S. Pat. No. 3,891,477 (Lance et al.) relates to a treatment process that uses cryogenic cooling and specifically includes the step of incrementally cooling a material from normal room temperature to about −320° F. by supporting the material above a body of liquid nitrogen and lowering the material toward the liquid nitrogen at a rate less than that at which thermal fracturing occurs. The rate of temperature reduction is effected in at least two stages above and below a predetermined thermal fracture threshold for the material. The material is thereafter immersed into the liquid nitrogen for a period within the range of about 18 hours to about 30 hours. When the immersion step is complete, the material is separated from the liquid nitrogen and permitted to return to room temperature.

Thus, the process described in the Lance Patent involves lowering the temperature of the material at two separate temperature reduction rates and immersing the material in liquid nitrogen for an extended period of time, namely about 18 to about 30 hours. The Lance Patent claims that these controlled steps, including the extended immersion of the material in the liquid nitrogen, eliminate the need for a heating step or steps. Moreover, according to the Lance Patent specification, other processes, in which a material is cooled to subzero temperatures and subsequently heated to elevated temperatures in the range of 300° F. to 500° F., merely provide surface hardness rather than a uniform refined microstructure throughout the treated material.

U.S. Pat. No. 3,819,428 (Moore) relates to a metal hardening process in which a metal is first heated in two stages up to a temperature in the range of 750° C. to 1325° C. (1382° F. to 2417° F.) for a short period, quenched, and then cooled to a temperature of about −80° C. to −120° C. (−112° F. to −184° F.) by direct contact with cold gas or indirect contact with cold gas or cold liquid. The cooling step in the example given in the Moore Patent was performed for about twenty minutes. After the cooling step, the material is subjected to a final single tempering within the range of 150° C. to 600° C. (302° F. to 1112° F.).

The Moore Patent specifies that in the cooling step, temperatures below −120° C. (−184° F.) and direct contact of a treated metal with cold liquid are to be avoided. Both occurrences are said to cause undue stress or impose severe strain on the metal structure.

Still other similar processes are known. As an example, U.S. Pat. No. 2,197,365 (Kjerrman) relates to a method of hardening a steel article by subjecting it to successive heating, cooling, and heating steps. The initial heating step is to about 850° C. (1562° F.); the intermediate cooling step is ultimately to about −78° C. (−108° F.); and the subsequent heating tep is to about 200° C. (392° F.).

As a further example, U.S. Pat. No. 2,958,617 (Perry) relates to a method for hardening stainless steel by initially heating it to about 1700° F. to 1850° F. and subsequently cooling it to about 850° to 950° F., forming the steel into a part, and reheating it to 950° F. to 1150° F. and then refrigerating it at about −30° F. to about −150° F. Ultimately, the steel is reheated to 700° F. to about 1150° F.

U.S. Pat. No. 3,185,600 (Dullberg) relates to a method of hardening metal that includes heating the metal by a solution heat treatment and thereafter introducing the metal at the temperature of the solution treatment directly into a quenching medium to reduce its temperature rapidly to below about −50° F.

U.S. Pat. No. 2,990,275 (Binder et al.) relates to a hardenable stainless steel which includes an aggregate of cobalt and nickel sufficient to impart a substantially austenitic structure at temperatures above about 950° C. (1742° F.).

Still another process for treating a metal is described in U.S. Pat. No. 2,624,688 (Svensen) and involves preheating the metal to 1250° F. to 1300° F., rapidly heating the metal to a hardening temperature of 1575° F. to 1600° F., and then quenching the metal to no less than 100° F. to 110° F. The metal is then tempered at 200° F. and subsequently subjected to cold treatment at −125° F. to −150° F. Then the metal is finally subjected to another tempering, cooling, tempering cycle.

U.S. Pat. No. 2,949,392 (Willey) discloses a method for relieving residual stresses in light metal articles that includes cooling the article to temperatures below −100° F. and as low as −425° F. for short periods of time and than subjecting the articles to a current of condensable vapor at a temperature not lower than the boiling point of water.

Materials Improvement, Phoenix, Ariz. has offered a commercial material treatment process in which metals are cooled in a dry atmosphere to temperatures below −300° F. for periods in excess of 24 hours and below −100° F. for 60 hours. The long period of exposure to cold temperatures is claimed to result in a more uniform, refined microstructure with greater density in a stabilized form of the metals. After the cold treatment the material returns to room temperature and is then heated to about 300° F. The Materials Improvement process has the disadvantage of requiring expensive refrigeration equipment to create the cold, dry atmosphere and taking a long time to complete.

SUMMARY OF THE INVENTION

It is a principal object of the present invention to provide a process for treating materials to improve their structural characteristics that constitutes an improvement over know processes such as those described above.

More particularly, it is an object to the present invention to provide a process for treating materials that improves their structural characteristics so as to provide longer useful life by reducing the rate at which they wear or are consumed.

It is still a further object of the present invention to provide a process for treating materials that may be completed in a relatively short period of time and that utilizes inexpensive equipment and materials. Thus the process of the invention provides significant economies both because it can be practiced inexpensively and because parts made of material treated by it out last by a surprising degree similar parts made of the same but untreated material.

In its preferred embodiment, the present invention comprises a series of steps for changing the temperature of a material over precise periods of time. This particular combination of steps has been found to provide startling improvement in the structural characteristics of various materials, notably metals, and may be performed in less than about thirty one hours.

In the preferred embodiment, the present invention generally includes the steps of suspending the material to be treated closely above a cryogenic liquid for between about two hours and about four hours. Thereafter, the material is immersed from its suspended location into the cryogenic liquid within about two seconds to about ten seconds. The rate of evaporation of the cryogenic liquid is subsequently controlled so that the material is completely exposed to only gases within about five hours to about ten hours, after which the temperature of the material is controlled to rise from the cryogenic level to about −50° F. within about eleven hours to about sixteen hours. After the temperature of the material has risen to about −50° F. at the prescribed rate, the material is allowed to return to ambient temperature of between about 65° F. and about 70° F. Thereafter the material is heated to an elevated temperature within the range of about 330° F. to about 370° F. for between about one hour and about five hours. Finally, the material is again allowed to return to ambient temperature and the process is complete.

Parts and tools made of materials treated by the process briefly described above have been found to provide as many as seventeen times more operations before reconditioning than do similar parts made with the same but untreated material.

The objects set forth above and other objects, aspects, and advantages of the present invention will be pointed out in, or be understood from, the following detailed description provided below in conjunction with the accompanying drawing.

BRIEF DESCRIPTION OF THE DRAWING

The sole FIGURE is a flow diagram of the general steps for treating materials to improve their structural characteristics in accordance with the present invention.

DETAILED DESCRIPTION OF THE PREFERRED EMBODIMENT

The preferred embodiment of the present invention treats materials, including metals, by subjecting them to controlled changes in temperature in specific ways for specific periods of time. More particularly, the invention comprises cooling the material from ambient temperature of about 65° F. to about 70° F. in a controlled matter to a cryogenic level through several steps, returning the temperature of the material to ambient temperature in a controlled matter through several additional steps, and heating the material to a specific temperature for a specific period of time through several more steps. Thereafter, the material is returned to ambient temperature and the process is complete.

The process of the invention is practiced with simple and inexpensive apparatus that does not include complex mechanical refrigeration equipment. Indeed, the basic apparatus used in the invention includes an insulated container, generally known as a Dewar box and a conventional oven capable of heating to temperatures up to at least about 370°.

The materials treated may be, for example, tool steel or copper. Further, it is possible to treat at one time a large number of parts such as drill bits or welding tips respectively made with such materials. In order to treat a large number of drill bits, to take an example, a Dewar box is used that measures about twenty inches in length by about twenty four inches in width by about thirty inches in height and has about two inches of insulation on all of its walls. The box, which is advantageously made of stainless steel, is equipped with interchangeable loosely fitting insulating and tightly fitting insulating covers that enclose the interior of the box. The loosely fitting cover may be a panel of styrofoam about two inches thick, and the tighty fitting cover may have construction similar to that of the walls of the box but has a suitable structure for being tightly and sealingly secured to the box.

In practicing the process of the present invention, the part or parts to be treated are placed in an open receptacle such as a basket or a pan. A basket measuring 16" length, 15" width, 2" depth which accommodates a pile of parts 2" high has been used. If the parts are made out of copper, they should be first cleaned with a degreaser. Other metals should be coated with a light oil to enhance their appearance after the treatment process is complete and to prevent corrosion.

In preparation for practicing the process of the invention, an amount of cryogenic liquid sufficient to completely cover the parts to be treated after an initial suspension step is introduced into the Dewar box. Use of liquid nitrogen as the cryogenic liquid is particularly advantageous because it is readily available, relatively inexpensive, easy to handle, and has a cryogenic melting temperature of about −320° F.

After the box has been provided with the cryogenic liquid, the process is practiced as follows:

In Step 1 as shown in the FIGURE the basket containing the part or parts to be treated is lowered into the Dewar box and suspended closely above the surface of the cryogenic liquid. It is preferred that the material be suspended initially about one-half inch above the cryogenic liquid surface, it being recognized that evaporation of the cryogenic liquid will cause its surface to recede from the suspended parts. This fact should be taken into account in determining the quantity of cryogenic liquid initially placed in the Dewar box for reasons which will become apparent below.

After the parts are initially suspended in the Dewar box, the box is enclosed with the loosely fitting cover to limit the infiltration of heat. The parts are permitted to remain at the suspended position in the loosely covered Dewar box for about two hours to about four hours. It has been found that a suspension time of about three hours is optimal and that the temperature of the parts drops to about −120° F. to about −125° F. during this time.

After the parts have been suspended above the cryogenic liquid for a period as specified above, they are promptly lowered from their suspended location into the cryogenic liquid to be completely immersed therein in Step 2. The time taken to move the parts from their suspended location to their completely immersed position is about two seconds to about ten seconds.

When the cryogenic material is liquid nitrogen, it has been observed to bubble for approximately two to three minutes after the immersing step.

After the parts are immersed in the cryogenic liquid, any suspension system such as cables or chains attached to the basket for holding them is removed. The Dewar box is then covered with the tightly sealing cover.

After the parts are completely immersed and the Dewar box is sealed, the rate of evaporation of the cryogenic liquid is controlled so that the parts are completely exposed to only gases within about five hours to about ten hours in Step 3. It has been found that an immersion time of about seven hours to about seven and one-half hours is optimal. As an example, if the parts are initially immersed in five inches of liquid nitrogen, the rate of evaporation is controlled to be about 0.714 inch to about 0.666 inch per hour, which leaves the parts exposed to only gases within seven to seven and one-half hours. It has been found that immersion of parts in the cryogenic liquid for less than five hours or more than ten hours does not provide acceptable results such as those which will be described in detail below with reference to examples. It is believed that immersion for less than or greater than the lower and upper temperature parameters "shocks" the material causing it to be more likely to crack or fracture.

The rate of evaporation of the cryogenic liquid may be controlled as follows: The tighly sealing cover of the Dewar box can be provided with a vent having a size that can be adjusted for controlling the rate of evaporation. As an alternative to or as an addition to an adjustible vent in this cover, the Dewar box may be equipped with a fan to agitate the gases above cryogenic liquid or may be equipped with a suitable device for supplying heat to the liquid. With such devices, the rate of evaporation can be precisely controlled.

If the material being treated is embodied as a plurality of individual parts, all parts, including the uppermost, must initially be completely immersed in the liquid. Further, each part should be in contact with at least one other part. After the controlled evaporation of the cryogenic liquid, all parts, including the lowermost, are exposed only to gases. It will be apparent that during the evaporation step, parts piled above others will become exposed only to gases in less time than those beneath. However, it has been found that if each part is in contact with at least one other, the parts more quickly exposed only to gases are, nevertheless, maintained at substantially the temperature of the cryogenic liquid by virtue of heat conduction until all parts are exposed only to gases.

After all parts are exposed only to gases, their temperature is then controlled to rise from the cryogenic level to about −50° within about eleven hours to about sixteen hours in Step 4. This step may be accomplished by leaving the tightly sealing cover on the Dewar box for the requisite period and, thereafter, removing the cover to provide access to the parts. It has been found that permitting the parts to remain in the Dewar box with the tightly sealing cover thereon for about twelve hours to about fourteen hours, and more precisely for about thirteen and one-half hours, after the parts are exposed to only gases is optimal and provides the required controlled elevation of the temperature of the parts to about −50° F.

After the tightly sealing cover is taken off of the Dewar box, the parts are placed in the ambient atmosphere and permitted to return to ambient temperature in Step 5. This step requires about three hours.

In Step 6, after the material has returned to ambient temperature, it is heated to a temperature within the range of about 330° F. to about 370° F., for a time within about one hour to about five hours. It has been found that heating the parts for less than one hour does not provide acceptable results such as those described in the examples below. Heating for more than five hours has not been found to improve the results of the process. Additionally, a heating temperature of about 350° F. has been found to be optimal. At temperatures respectively above and below the upper and lower heating temperature limits mentioned above, substantially less satisfactory results have been obtained.

This Step 6 may be conveniently performed with a conventional oven, such as a residential electric kitchen oven. It has been found that the optimal way of performing this Step 6 is to place the parts in the oven, which is set to 350° F. and promptly turned on by supplying energy to it. After about three hours, the oven is turned off. Thereafter, within about one-half hour to about one hour, the parts are removed from the oven and placed in the ambient atmosphere, so that they may return to ambient temperature in Step 7. When the parts have returned to ambient temperature, the process is complete and the parts can be put into service.

It will be appreciated that the process in accordance with the preferred embodiment of the invention is practiced with relatively inexpensive and readily available equipment and materials. While liquid nitrogen is the preferred cryogenic liquid used for practicing the process for the reasons mentioned above, other cryogenic liquids may also be used. However, it will be understood that for purposes of this specification and the concluding claims, the term "cryogenic liquid" is considered to be a liquid having a temperature of about −300° F. or less.

Comparison tests have been done between untreated parts and parts treated with the process of the invention at the optimal times and temperatures for each of the steps, and in the optimal manners described above. The results of these tests are set forth in the following examples.

EXAMPLE 1

| Tool Steel Drill Bits | Capability |
|---|---|
| Untreated | Capable of drilling 200 holes before resharpening |
| Treated | Capable of drilling 3,400 holes before resharpening |

EXAMPLE 2

| Tool Steel Cutting Knives | Capability |
|---|---|
| Untreated | Capable of making 800,000 cuts before resharpening |

-continued

| Tool Steel Cutting Knives | Capability |
|---|---|
| Treated | Capable of making 2,600,000 cuts before resharpening |

EXAMPLE 3

| Tool Steel Sleeve Dies | Capability |
|---|---|
| Untreated | Capable of making 110,000 sleeves before resharpening |
| Treated | Capable of making 600,000 sleeves before resharpening |

EXAMPLE 4

| Tool Steel Punches | Capability |
|---|---|
| Untreated | Capable of punching 150 holes before resharpening |
| Treated | Capable of punching 1300 holes before resharpening |

In each of the examples described above, the material operated on by the treated and untreated parts was the same. Accordingly, it will be appreciated that the performance of the treated parts exceeds that of the untreated parts by as much as 17 times. That is, in Example 1, treated tool steel drill bits exceeded the performance capability of untreated drill bits by 17 times. Thus, the treated bits have remarkably improved operating capabilities.

Moreover, it has been found that resharpening or resurfacing of each of the parts mentioned in Examples 1 through 4 above, removes far less material than a similar resharpening operation on untreated parts. For example, sharpening of untreated cutting knives often removes as much as one-eight of an inch of material. However, sharpening of treated cutting knives removes about 0.010 to about 0.012 inch of material.

The process described above has also been used to treat copper welding tips and treated tips have been compared with untreated tips, as set forth below in Example 5.

EXAMPLE 5

| Copper Welding Tips | Capability |
|---|---|
| Untreated | Capable of making welds for fabricating 1,200 wire shelves |
| Treated | Capable of making welds for fabricating 21,000 wire shelves |

In Example 5, the wire shelving made with both the untreated and treated copper welding tips incorporates a large number of welds. However, the total number of welds which the treated tips are capable of making exceeds that which the untreated tips are capable of making by a factor of about 17.

Additionally, it has been found that resurfacing of the copper welding tips removes less material when treated than when untreated. More particularly, resurfacing of untreated copper welding tips removes about one-quarter inch of material, while resurfacing of treated tips removes only about 0.010 to about 0.012 inch of material.

It will be apparent from the examples set forth above, that not only do parts treated with the process of the invention provide greatly improved wear characteristics, but that also these treated parts have extended useful life because they may be reconditioned by, for example, resharpening or resurfacing, more often. This follows from the fact that less material is removed from the treated parts than from untreated parts when they are reconditioned. Furthermore, reconditioning does not require retreatment with the process of the invention.

Accordingly, the material treatment process of the present invention and specifically the particular combination of steps described above provides greatly enhanced results as shown above with reference to the several examples.

While a specific embodiment and optimal parameters for the process for treating materials in accordance with the present invention have been described above in detail, modifications to this process may be made by those skilled in the art in order to adapt it to particular applications.

What is claimed is:

1. A process for treating a material to improve its structural characteristics, comprising the steps of:

A. suspending the material closely above a cryogenic liquid for between about two hours and about four hours;

B. after said suspending step, completely immersing the material from its suspended location into the cryogenic liquid within about two seconds to about ten seconds;

C. after said immersing step, controlling the rate of evaporation of the cryogenic liquid so that the material is completely exposed to only gases within about five hours to about ten hours;

D. after the material is completely exposed to only gases, controlling the temperature of the material to rise from the cryogenic level to about −50° F. within about eleven hours to about sixteen hours;

E. after the temperature of the material rises to about −50° F. in said immediately preceding controlling step, allowing the material to return to ambient temperature of between about 65° F. and about 70° F.;

F. after the temperature of the material reaches ambient temperature in said allowing step, heating the material to an elevated temperature within the range of about 330° F. to about 370° F. for between about one hour and about five hours; and G. allowing the material to return to ambient temperature.

2. A process for treating a material according to claim 1, wherein said suspending step comprises initially suspending the lowermost portion of the material about one-half inch above the surface of the cryogenic liquid.

3. A process treating a material according to claim 1, wherein the cryogenic liquid is contained in an insulated container and wherein said process further comprises the step of, after the material is initially suspended closely above the cryogenic liquid, enclosing the container with a loosely fitting cover.

4. A process for treating a material according to claim 1, wherein the cryogenic liquid is liquid nitrogen having a temperature of about −320° F.

5. A process for treating a material according to claim 1, wherein the cryogenic liquid is contained in an insulated container and wherein said step of controlling the rate of evaporation comprises tightly sealing the container with an insulated cover and providing a vent in the insulated cover, the size of which may be adjusted to control the rate of evaporation.

6. A process for treating a material according to claim 1, wherein the cryogenic liquid is contained in an insulated container and wherein step of controlling the rate of evaporation comprises agitating the gases above the cryogenic liquid.

7. A process for treating a material according to claim 1, wherein said step of controlling the rate of evaporation comprises applying heat to the cryogenic liquid.

8. A process for treating a material according to claim 1, wherein the cryogenic liquid is contained in an insulated container and wherein said step of controlling the temperature of the material to rise comprises tightly sealing the container with an insulated cover and maintaining the material within the tightly sealed container for a period within the range about eleven hours to about sixteen hours after the material is exposed to only gases.

9. A process for treating a material according to claim 1, wherein said allowing step prior to said heating step is performed within about three hours.

10. A process for treating a material according to claim 1, wherein said heating step comprises placing the material in an oven set to heat to a temperature with the range of about 330° F. to about 370° F., initiating supply of energy to the oven to start heating it to a temperature within the aforesaid range, and within about one hour to about five hours stopping supply of energy to the oven.

11. A process for treating a material according to claim 10, wherein said allowing step after said heating step comprises removing the material from the oven within about one-half hour to about one hour after said stopping step and placing the material in the ambient atmosphere.

12. A process according to claim 10, wherein said stopping step is performed about three hours after said initiating step.

13. A process for treating a material according to claim 1, wherein said suspending step is performed for about three hours.

14. A process for treating a material according to claim 1 wherein in said suspending step the temperature of the material falls from ambient temperature to about −120° F. to about −125° F.

15. A process for treating a material according to claim 1, wherein said immersing step is performed for about seven hours to about seven and one-half hours.

16. A process for treating a material according to claim 1, wherein said controlling step after said immersing step controls the temperature to rise from the cryogenic level to about −50° F. within about twelve hours to about fourteen hours.

17. A process for treating a material according to claim 1, wherein said heating step heats the material to a temperature of about 350° F.

18. A process for treating material according to claim 1, wherein said heating step in performed for about three hours.

19. A process for treating a material according to claim 1, wherein the material is a plurality of individual pieces, said suspending step comprises suspending the individual pieces in an open receptacle with each of the pieces in contact with at least one other thereof, said immersing step comprises immersing the receptacle and the individual pieces therein in the cryogenic liquid so that the uppermost of the pieces is initially covered by the cryogenic liquid, and said controlling step immediately following said immersing step comprises controlling the rate of evaporation of the cryogenic liquid so that the lowermost of the individual pieces is completely exposed to only gases within about five hours to about ten hours.

20. A process for treating a material according to claim 19, wherein said controlling step immediately following said immersing step comprises controlling the rate of evaporation of the cryogenic liquid so that the lowermost of the individual pieces is completely exposed to only gases within about seven hours to about seven and one-half hours.

21. A process for treating a material to improve its structural characteristics, comprising the steps of:

A. providing a pool of liquid nitrogen, having a cryogenic temperature of about −320° F., in a container;

B. suspending the material closely above the liquid nitrogen for a period of about three hours;

C. after said suspending step, completely immersing the material from its suspended location into the liquid nitrogen within at most about ten seconds;

D. after said immersing step, controlling the rate of evaporation of the liquid nitrogen so that the material is completely exposed to only gases within about seven hours to about seven and one-half hours;

E. after the material is completely exposed to only gases, controlling the temperature of the material to rise from the cryogenic temperature to about −50° F. within about 12 hours to about 14 hours;

F. after the temperature of the material rises to about −50° F. in the immediately preceding controlling step, allowing the material to return to ambient temperature of between 65° F. and about 70° F.;

G. after the temperature of the material reaches ambient temperature in the allowing step, heating the material to about 350° F. for about three hours; and H. allowing the material to return to ambient temperature.

22. A process for treating a material according to claim 21, wherein said suspending step comprises initially suspending the lowermost portion of the material about one-half inch above the surface of the liquid nitrogen.

23. A process for treating a material according to claim 21, wherein the container for the liquid nitrogen is insulated and wherein said process further comprises the step of, after the material is initially suspended closely above the liquid nitrogen, enclosing the container with a loosely fitting cover.

24. A process for treating a material according to claim 21, wherein the container is insulated and said step of controlling the rate of evaporation comprises tightly sealing the container with an insulted cover having a vent therein, the size of which may be adjusted to control the rate of evaporation.

25. A process for treating a material according to claim 21, wherein said step of controlling the rate of evaporation comprises agitating the gases above the liquid nitrogen to control its rate of evaporation.

26. A process for treating a material according to claim 21, wherein said step of controlling the rate of evaporation comprises applying heat to the liquid nitrogen.

27. A process for treating a material according to claim 21, wherein said step of controlling the temperature of the material to rise comprises tightly sealing the container with an insulated cover and maintaining the material within the tightly sealed container for a period within the range of about 12 hours to about 14 hours after the material is exposed to only gases.

28. A process for treating a material according to claim 21, wherein said allowing step prior to said heating step is performed within about three hours.

29. A process for treating a material according to claim 21, wherein said heating step comprises placing the material in an oven set to heat to a temperature of about 350° F., initiating supply of energy to the oven to start heating it to the aforesaid temperature, and about three hours after said initiating step, stopping supply of energy to the oven.

30. A process for treating a material according to claim 29, wherein said allowing step after said heating step comprises removing the material from the oven within about one-half hour to to about one hour after said stopping step and placing the material in the ambient atmosphere.

31. A process for treating a material according to claim 21, wherein in said suspending step the temperature of the material falls from ambient temperature to about −120° F. to about −125° F.

32. A process for treating a material according to claim 21, wherein the material is a plurality of individual pieces, said suspending step comprises suspending the pieces in an open receptacle with each of the pieces in contact with at least one other thereof; said immersing step comprises immersing the receptacle and the individual pieces therein in the liquid nitrogen so that the uppermost of the pieces is initially covered by the liquid nitrogen, and said controlling step immediately following said immersing step comprises controlling the rate of evaporation of the liquid nitrogen so that the lowermost of the individual pieces is completely exposed to only gases within about seven hours to about seven and one-half hours.

33. A process for treating a material to improve its structural characteristics, comprising the steps of:

A. providing an insulating container having interchangeable and removable loosely fitting and tightly sealing insulated covers;

B. placing a pool of liquid nitrogen in the container, the liquid nitrogen having a cryogenic temperature of about −320° F.;

C. placing the material in an open receptacle and suspending the receptacle and the material with the lowermost portion thereof at a distance initially about one-half inch above the surface of the liquid nitrogen;

D. covering the container with the loosely fitting cover;

E. about three hours after the receptacle and the material are initially suspended above the liquid nitrogen, lowering the receptacle and the material into the liquid nitrogen to completely immerse the uppermost portion of the material therein;

F. interchanging the tightly sealing cover for the loosely fitting cover on the container to tightly seal the container;

G. after the container has been tightly sealed with said tightly sealing cover, controlling the rate of evaporation of the liquid nitrogen to completely expose the lowermost portion of the material to only gases within about seven hours to about seven and one-half hours, said controlling step being performed by at least one of providing a vent in the tightly sealing cover, the size of which may be adjusted, aggitating the gases above the liquid nitrogen, and applying heat to the liquid nitrogen;

H. after the lowermost portion of the material is exposed only to gases, maintained the material in the tightly sealed container for a period within the range of about twelve hours to about fourteen hours and thereby controlling the temperature of the material to rise from the cryogenic temperature to about −50° F.;

I. after said maintaining step, removing the tightly sealing cover from the container;

J. removing the material from the container, placing it in ambient atmosphere and allowing it to return to ambient temperature of about 65° F. to about 70° F.;

K. after the temperature of the material reaches ambient temperature, placing it in an oven set to heat to about 350° F. and promptly initiating supply of energy to the oven to start heating it to the aforesaid temperature;

L. stopping supply of energy to the oven about three hours after the initiating step; and M. allowing the material to return to ambient temperature.

34. A process for treating a material to improve its structural characteristics, comprising the steps of:

A. providing an insulated container having a tightly sealing cover;

B. providing a pool of a cryogenic liquid in the container;

C. suspending the material closely above the cryogenic liquid for between about two hours and about four hours;

D. after the suspending step, completely immersing the material from its suspended location into the cryogenic liquid within about two seconds to about ten seconds;

E. covering the container with the tightly sealing cover and controlling the rate of evaporation of the cryogenic liquid so that the material is completely exposed to only gases within about five hours to about ten hours;

F. removing the tightly sealing cover from the container within about eleven hours to about sixteen hours after the material is exposed to only gases;

G. removing the material from the container and allowing the material to return to ambient temperature of about 65° F. to about 70° F.;

H. heating the material to a temperature within the range of 330° F. to about 370° F. for between about one hour and about five hours; and I. allowing the material to return to ambient temperature.

* * * * *

UNITED STATES PATENT AND TRADEMARK OFFICE

CERTIFICATE OF CORRECTION

PATENT NO. : 4,482,005

DATED : November 13, 1984

INVENTOR(S) : JOSEPH E. VOORHEES

It is certified that error appears in the above-identified patent and that said Letters Patent is hereby corrected as shown below:

Column 2

Line 44, change "than" to --then--,

Line 65, change "know" to --known--.

Column 5

Line 35, change "tighly" to --tightly--.

Column 7

Line 43, change "one-eight" to --one eighth--.

Column 9

Line 67, change "in" to --is--.

Column 12

Line 14, change "aggitating" to --agitating--.

UNITED STATES PATENT AND TRADEMARK OFFICE

CERTIFICATE OF CORRECTION

PATENT NO. : 4,482,005

DATED : November 13, 1984

INVENTOR(S) : JOSEPH E. VOORHEES

It is certified that error appears in the above-identified patent and that said Letters Patent is hereby corrected as shown below:

Column 12 (continued)

Line 17, change "maintained" to --maintaining--.

Signed and Sealed this

Seventh Day of January 1986

[SEAL]

*Attest:*

DONALD J. QUIGG

*Attesting Officer*

*Commissioner of Patents and Trademarks*